US005941371A

United States Patent [19]

Kautz et al.

[11] Patent Number: 5,941,371

[45] Date of Patent: Aug. 24, 1999

[54] ELECTRICAL SWITCH WITH LATCHING MANUAL/AUTOMATIC RESET

[75] Inventors: Thomas O. Kautz, Mequon; Frank J. Stier, South Milwaukee, both of Wis.

[73] Assignee: Johnson Controls Technology, Inc., Plymouth, Mich.

[21] Appl. No.: 09/099,257

[22] Filed: Jun. 18, 1998

[51] Int. Cl.[6] ..... H01H 1/52

[52] U.S. Cl. ..... 200/318; 200/321

[58] Field of Search ..... 200/378.1, 378.2, 200/378, 321, 322, 407

[56] References Cited

U.S. PATENT DOCUMENTS

| | | | |
|---|---|---|---|
| Re. 28,578 | 10/1975 | Burch et al. | 200/67 |
| 3,697,915 | 10/1972 | Brassard | 337/74 |
| 3,946,352 | 3/1976 | Nelson | 337/361 |
| 4,032,734 | 6/1977 | Burch | 200/67 |
| 4,297,552 | 10/1981 | Lauritsen et al. | 200/83 |
| 4,325,046 | 4/1982 | Burch | 337/56 |
| 4,424,506 | 1/1984 | Burch | 337/365 |
| 4,796,355 | 1/1989 | Burch et al. | 29/622 |
| 5,001,317 | 3/1991 | Atkinson et al. | 200/834 |
| 5,565,666 | 10/1996 | Kautz | 200/83 |

*Primary Examiner*—Michael L. Gellner
*Assistant Examiner*—Nhung Nguyen
*Attorney, Agent, or Firm*—Quarles & Brady LLP

[57] ABSTRACT

An electrical switch has a snap action blade with a contact pad. The snap action blade levers between a first configuration at which the contact pad is remote from a stationary contact and a second configuration at which the contact pad abuts the stationary contact. An actuator moves the snap action blade between the first and second configurations. A reset latch has a first position in which a catch coupled to the snap action blade can engage the reset latch to hold the snap action blade in one of the first and second configurations, and has a second position at which such latching does not occur. A manual reset actuator is provided to release the catch from the reset latch. A reset selector determines whether the reset latch is in the first or second position and thus whether the switch is in an automatic reset mode or a manual reset mode.

16 Claims, 7 Drawing Sheets

ELECTRICAL SWITCH WITH LATCHING MANUAL/AUTOMATIC RESET

BACKGROUND OF THE INVENTION

The present invention relates to electrical switches having contacts that move from a first state to a second state when acted upon by an actuator; and more particularly to such switches which include a reset mechanism for returning the contacts to the first state when no longer acted upon by the actuator.

U.S. Pat. No. 5,565,666 discloses a switch for interrupting an electrical circuit in response to a mechanical condition, such as an over pressure or under pressure condition detected in a conduit. The switch includes a support arm that is electrically connected to an electrical terminal and movable between a first position and a second position in response to the mechanical condition. The switch includes a snap action blade operatively connected to the support arm. The snap action blade levers from a first configuration to a second configuration when the support arm moves from the first position to the second position. In the first configuration, the snap action blade disengages a contact connected to another electrical terminal to interrupt the electrical circuit. The snap action blade engages the contact to complete the electrical circuit in the second configuration. The snap action blade is stable in both the first and second configurations and remains in the respective configuration until acted upon by an external force.

This type of switch further includes a reset actuator disposed to engage the snap action blade in response to manual activation. The snap action blade levers from the first configuration to the second configuration only when the reset actuator engages the snap action blade and the support arm is not in the second position. Thus the only way in which the snap action blade can be returned to the second configuration to complete the electric circuit is upon manual activation of the reset actuator. This reset is referred to as being "manual" in that it requires activation of the reset actuator even though such activation may be controlled by a mechanical actuator which does not require human intervention.

SUMMARY OF THE INVENTION

A general object of the present invention is to provide an electrical switch which allows the user to select between manual and automatic reset operation.

Another object of the present invention is to allow the user to reversibly select either manual or automatic reset operation.

These and other objectives are satisfied by an electrical switch having a stationary contact and a movable contact. The movable contact can be alternately placed into a first configuration at which the movable contact is remote from the stationary contact and a second configuration at which it abuts the stationary contact. A switch actuator produces movement of movable contact into one of the first and second configurations.

A reset latch has a first position and a second position. The movable contact includes a catch which engages the reset latch in only the first position when the movable contact is in only one of the first and second configurations. That engagement of the catch with the reset latch holds the movable contact in the one of the first and second configurations. In the preferred embodiment a reset selector is provided that enables a person to place reset latch either in the first position or the second position.

DETAILED DESCRIPTION OF THE INVENTION

Figure 1:
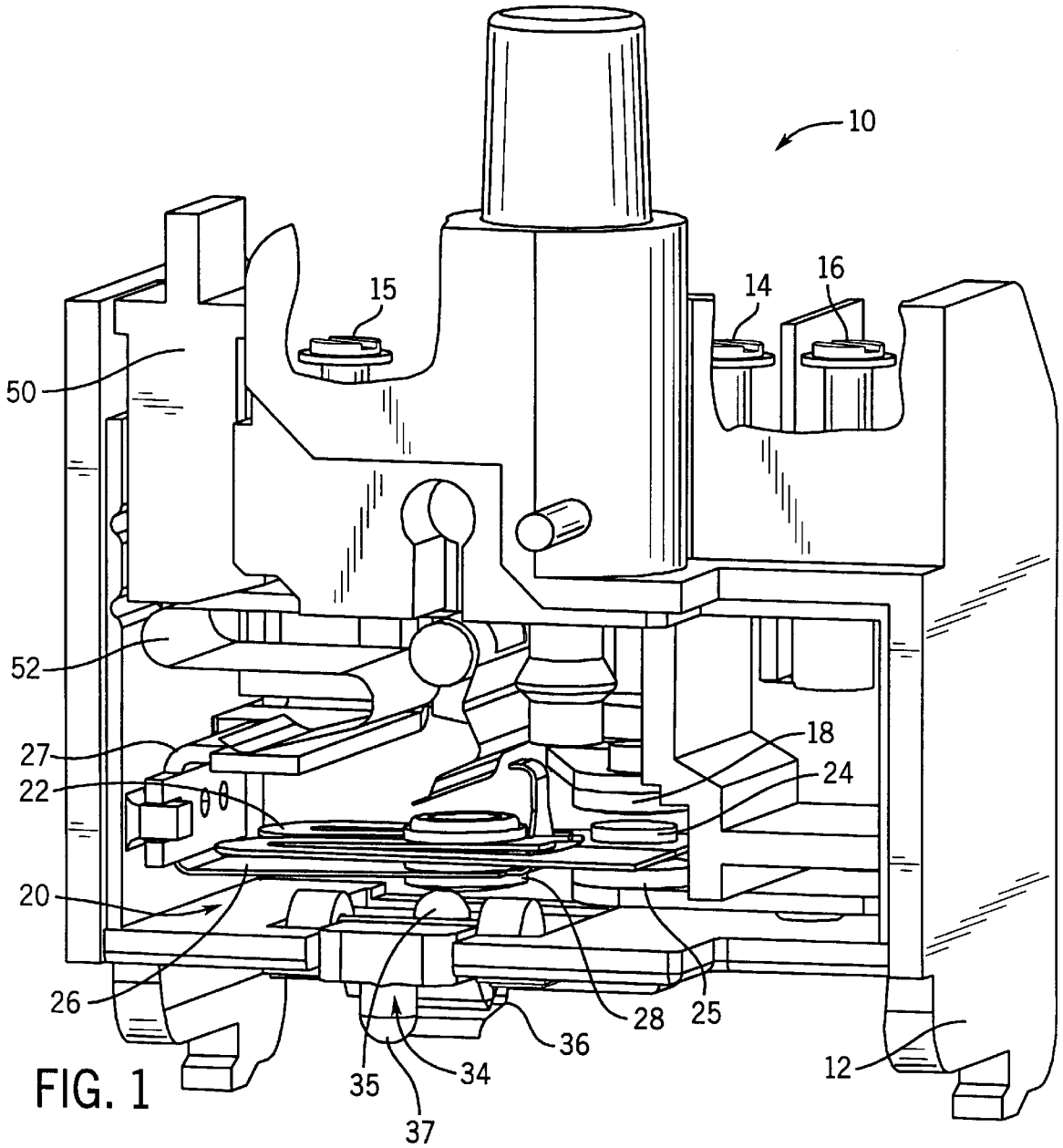
FIG. 1 show a switch that incorporates the present invention with the contacts in a first position.

With initial reference to FIG. 1, an electrical switch 10 includes a housing, or body, 12 of an electrically insulating material, such as plastic. The housing has three terminals 14, 15 and 16 which enable the switch to be connected to an external electrical circuit. One of the electrical terminals 14 is connected to a first stationary contact 18, while another terminal 16 is connected to a second stationary contact 25. The common terminal 15 is connected to a movable contact assembly 20. The movable contact assembly 20 has a snap action blade 22 with a contact 24, in the form of a pad, mounted thereon. Although the present invention is being described in the context of a switch with a snap action blade, the inventive concept can be used with other types of switching mechanisms.

Figure 2:
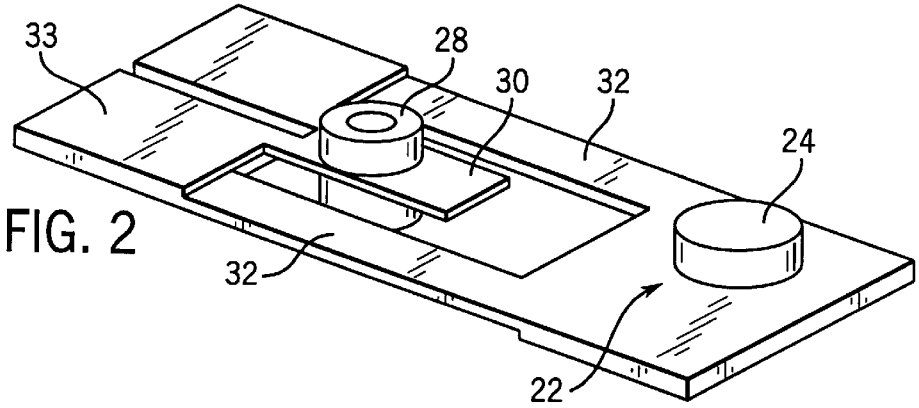
FIG. 2 is an isometric view of a snap action blade of the switch.
Figure 3:
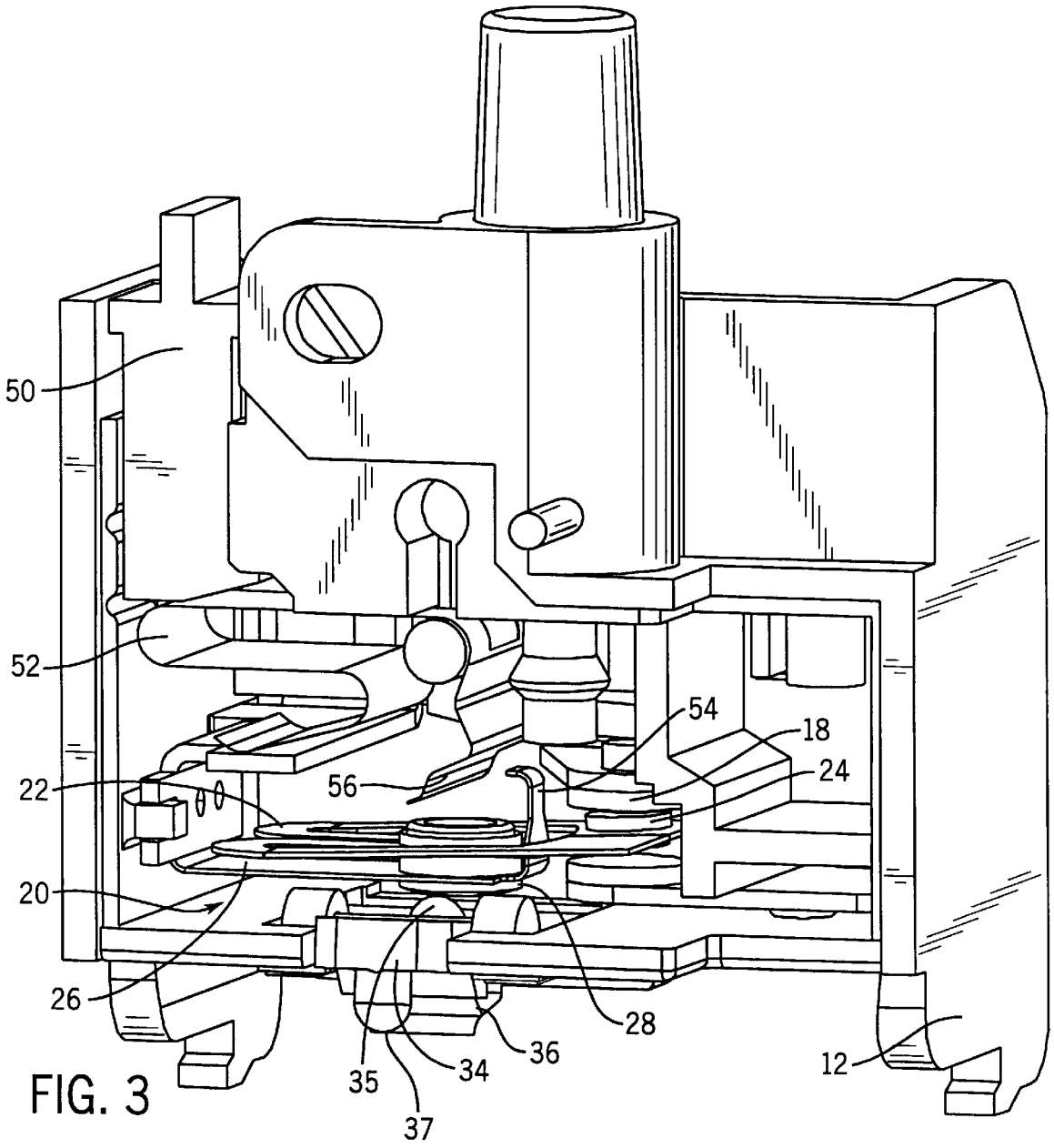
FIG. 3 is a view of the switch with a side plate removed and the contacts into a second position.

The snap action blade 22 is similar to the one described in U.S. Pat. No. 5,565,666, the description of which is incorporated herein by reference. Snap action blade 22 is attached to a bias leaf spring 26 that extends from a conductor bar 27 which is held in the housing 12 and connected to terminal 15. Specifically, the snap action blade 22 and bias leaf spring 26 are coupled to a button 28 which is held in place by a rivet. As shown in detail in FIG. 2, the button 28 engages a center portion 30 of the snap action blade 22. The center portion 30 is flanked by two side legs 32 which extend from the center portion and meet at the contact 24. The center portion 30 lies in a first plane and the two side legs 32 lie in a second plane with the two planes intersecting at an end 33 of the snap action blade 22 which is remote from the contact 24. The snap action blade 22 has a first configuration where center portion 30 is on one side of the second plane as illustrated in FIG. 1 and has a second configuration where center portion is on the other side of the second plane as illustrated in FIG. 3. As will be described, snap action blade 22 can be levered between these two configurations.

An actuator 34 extends through an aperture in the bottom wall of the housing 12 and pivots within that aperture. A knob 35 projects from the interior surface at one end of the actuator 34 and is aligned beneath the button 28 of the movable contact assembly 20. Alternatively, the knob 35 may directly contact the bias leaf spring 26. The actuator 34 is normally biased by a leaf spring 36 into a pivotal position at which the knob 35 exerts force on the button 28. That force levers the snap action blade 22 into a state of the switch at which the electrical contacts 18 and 24 do not abut, instead the movable contact 24 engages the second stationary contact 25, as shown in FIG. 1. Specifically, that actuator force is transferred from the button 28 to the center portion 30 of the snap action blade 22 and pushes the first plane of the center portion upward through the second plane of the two legs 32. When this happens, the contact 24 on the end of the side legs 32 snaps away from the first stationary contact 18 into the first configuration in which contact 24 is against the second stationary contact 25.

When sufficient external force is applied to move the other end 37 of the actuator 34 upward, the actuator pivots against the force of the leaf spring 36 and knob 35 moves away from engagement with the snap action blade button 28. The bias leaf spring 26 provides a spring bias which causes the snap action blade 22 to be stable only in the second configuration, illustrated in FIG. 3. Thus the removal of the force exerted by leaf spring 36 and actuator 34 results in that spring force moving the first plane of the center portion 30 of the snap action blade 22 through the second plane of the two legs 32. When this happens, the contact 24 on the end of the side legs 32 snaps away from second stationary contact 25 out of the first configuration and into a second configuration where the movable contact 24 is against the first stationary contact 18, closing the electrical circuit.

This mode of operation is referred to as having an automatic reset in that the switch returns automatically to the closed state of contacts 18 and 24 upon application of an external force acting on end 37 of the actuator 34. This reset action does not require any other external force to be applied to the switch. Note that in the automatic reset mode, a conversion pin 50 is located in an outward position and does not exert substantial bending force on a reset latch 52. In this state, a catch 54 at the end of the bias leaf spring 26 can not engage a slot 56 in the reset latch 52. Therefore, the reset latch 52 does not affect the operation of the snap action blade 22.

Figure 4:
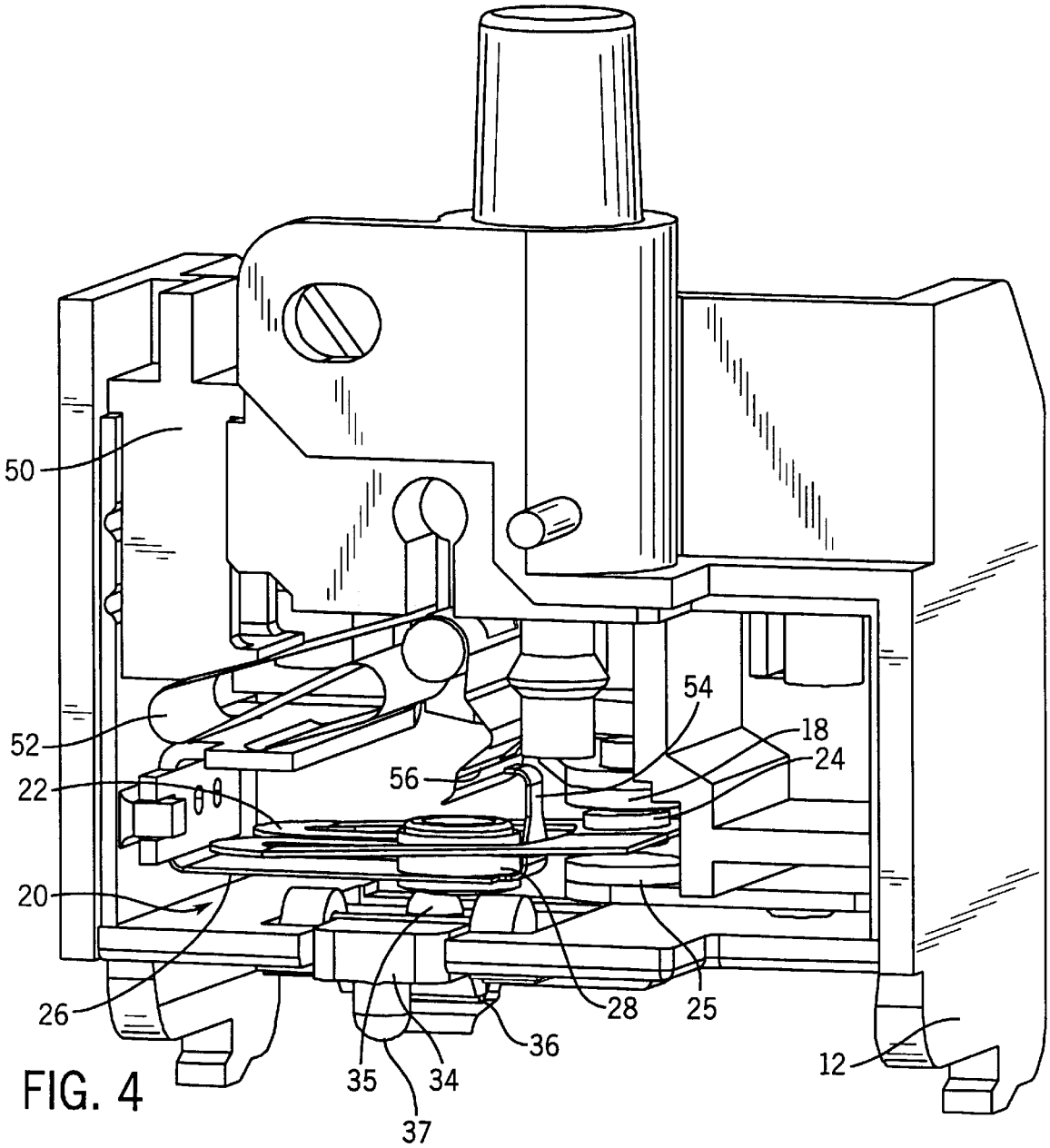
FIG. 4 is a view of the switch configured for a manual reset mode with the contacts in the second position.

With reference to FIG. 4, the automatic reset feature can be defeated to require that the switch be reset manually in order to return the switch contacts 18 and 24 to a closed state after being opened. To place the switch 10 into the manual reset mode, the conversion pin or reset selector 50 is pushed into the housing 12. This causes the interior end of the conversion pin 50 to push one portion of the reset latch 52 downward, thereby pivoting the reset latch so that the portion with slot 56 moves toward the catch 54.

In this position of the reset latch 52, when the external force is removed from the end 37 of the actuator 34, the internal knob 35 moves against the button 28 of the snap action blade 22 due to the force of bias spring 36. The removal of the force levers the snap action blade 22 from the second configuration of the switch 10 shown in FIG. 4 to the first configuration shown in FIG. 5 at which contact 24 moves away from the first stationary contact 18 and against the second stationary contact 25. In this first configuration of the snap action blade 22, the catch 54 enters the slot 56 of the reset latch 52.

Figure 6:
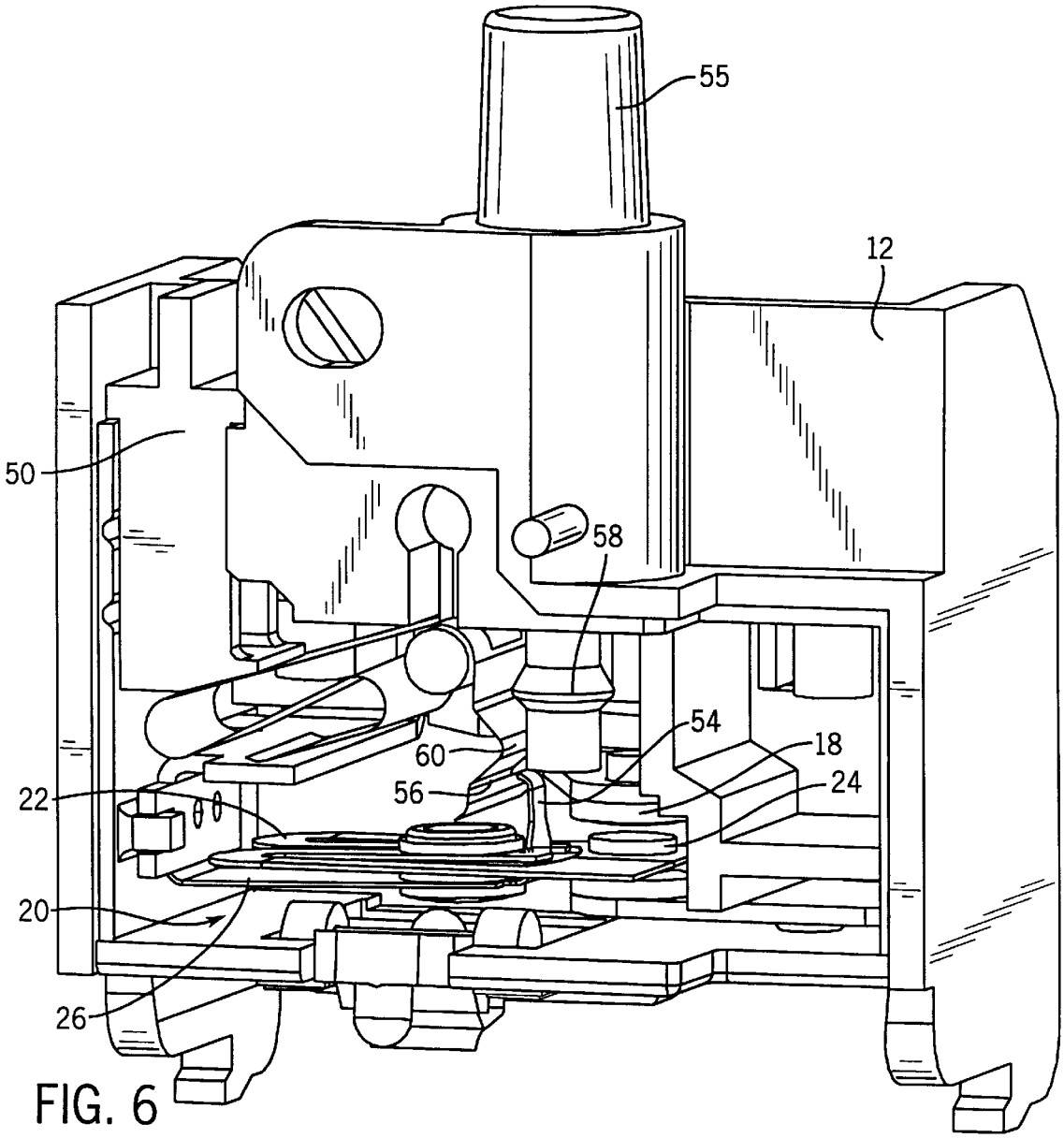
FIG. 6 illustrates the manual reset mode switch with the contacts in the first position and the actuator inactive.

Now when the external force is applied again to the end 37 of the actuator 34 and the internal knob 35 moves away from the button 28 of the snap action blade 22 as seen in FIG. 6, the engagement of the catch 54 with the reset latch 52 holds the snap action blade in the first configuration. In other words, that latching engagement prevents the force of bias leaf spring 26 from toggling the snap action blade 22 to close contacts 18 and 24. Thus regardless of the presence or absence of the external force acting on actuator 34, the contacts 18 and 24 remain open.

Figure 7:
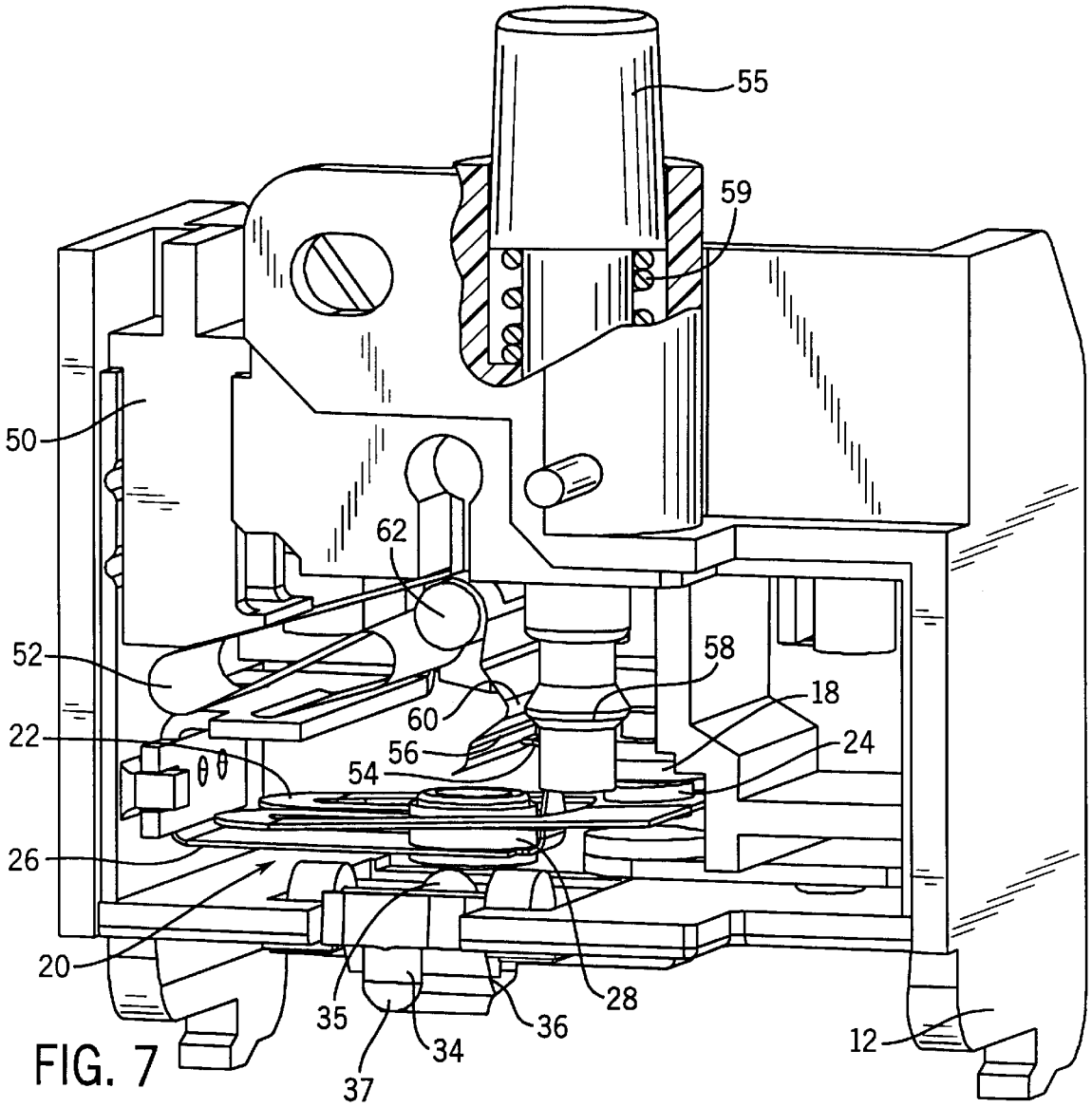
FIG. 7 is a view of the switch with the manual reset actuator moving the switch contacts into the second position.

In order to close contacts 18 and 24 in the manual reset mode, a person must depress a manual reset actuator 55 which has an annular rib 58 extending around an interior end section of that actuator. A compression spring 59 biases manual, reset actuator 55 outward from the housing 12, into a position at which the annular rib 58 does not engage the reset latch 52 as shown in FIG. 6. However, when a person pushes the manual reset actuator 55 into the housing as illustrated in FIG. 7, the annular rib 58 strikes a ridge 60 of the reset latch 52 bending the interior end of the reset latch around a pin 62 of the housing 12. As the interior end of the reset latch 52 bends, the catch 54 of the snap action blade 22 is released from the slot 56 of the reset latch. With the catch released, the snap action blade 22 is levered by the spring force of bias leaf spring 26 into the second configuration where the movable contact 24 is against the first stationary contact 18 as illustrated.

Figure 5:
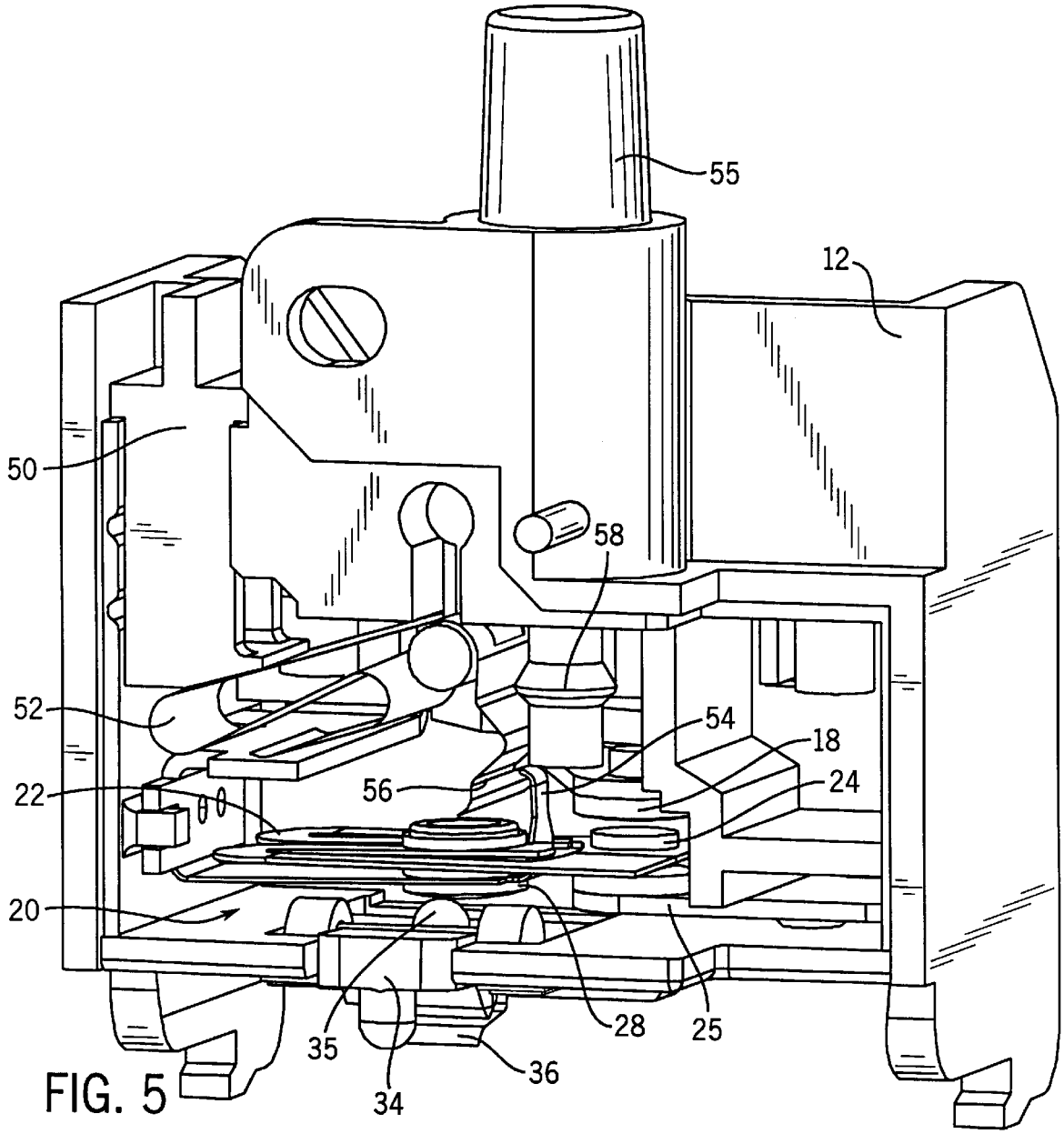
FIG. 5 shows the switch in the manual reset mode with the actuator moving the contacts into the first position.
Figure 8:
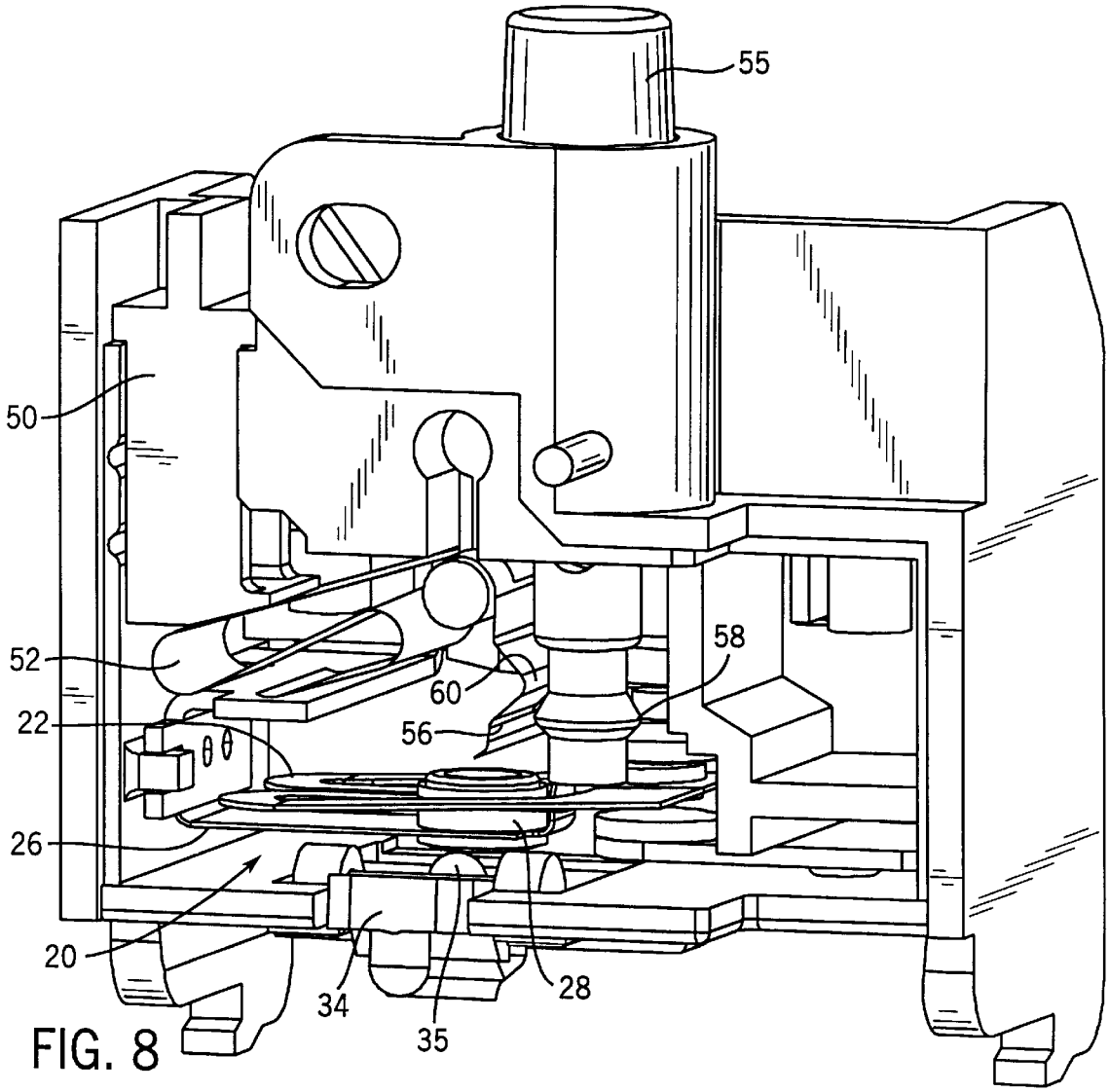
FIG. 8 shows the manual reset actuator moved to another location.

Further depression of the manual reset actuator 55 fully into the housing 12 as shown in FIG. 8 causes the annular rib 58 of manual reset actuator 55 to move past the ridge 60 of the reset latch 52. This allows the reset latch to revert back to the same operational position as if the manual reset actuator 55 was released as depicted in FIGS. 5 and 6. When the person releases the manual reset actuator 55, the internal spring 59 returns that actuator to the outward position.

Thus when the conversion pin 50 is in the position illustrated in FIGS. 4–8, the automatic reset mode of switch 10 is defeated requiring manual reset in order to return the contacts 18 and 24 from the open state to the closed state.

It should be noted that the user of the electrical switch 10 can move the conversion pin 50 from the inward position illustrated in FIGS. 4–7 to the outward position illustrated in FIGS. 1 and 3 thereby releasing the force of the conversion pin against the reset latch 52 and returning the switch 10 to the automatic reset mode.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example, the present inventive concept can be applied to other types of snap action switches and even to non-snap action switches. Accordingly, the scope of the invention should be determined from the following claims and not limited by the above disclosure.

We claim:

1. An electrical switch comprising:

a reset latch having a first position and a second position;

a stationary contact;

a movable contact movable between a first configuration at which the movable contact is remote from the stationary contact, and a second configuration at which the movable contact abuts the stationary contact, the movable contact having a catch which engages the reset latch in only the first position when the movable contact is in only one of the first and second configurations, wherein engagement of the catch with the reset latch holds the movable contact in the one of the first and second configurations;

an actuator which moves the movable contact between the first and second configurations.

2. The electrical switch as recited in claim 1 further comprising a reset selector that operatively determines whether reset latch is in the first position or the second position.

3. The electrical switch as recited in claim 1 further comprising a manually operable reset actuator for selectively exerting force which releases engagement of the catch with the reset latch.

4. The electrical switch as recited in claim 1 wherein the movable contact is a snap action blade having a contact pad which selectively engages the stationary contact.

5. The electrical switch as recited in claim 4 wherein the snap action blade comprises a center portion, and a first leg and a second leg both joined to the center portion, the first leg and the second leg lying in a first plane and the center portion lying in a second plane, the snap action blade toggling between the first configuration and the second configuration when the first plane and the second plane cross.

6. The electrical switch as recited in claim 5 wherein the contact pad of the snap action blade is coupled to the first leg and the second leg.

7. The electrical switch as recited in claim 5 wherein the catch is coupled to the center portion.

8. The electrical switch as recited in claim 1 wherein the movable contact comprises:

a bias leaf spring; and a snap action blade having a center portion attached to the bias leaf spring and being selectively engaged by the switch actuator and the reset spring, first and second legs both joined to the center portion, and a contact pad coupled to the first and second legs, the center portion lying in a first plane and the first and second legs lying in a second plane, the snap action blade toggling between the first configuration and the second configuration when the first plane crosses the second plane.

9. The electrical switch as recited in claim 8 wherein the bias leaf spring has a portion that forms the catch.

10. An electrical switch comprising:

a reset latch having a first position and a second position;

a reset selector that acts on the reset latch to select whether the reset latch is in the first position or the second position;

a stationary contact;

a movable contact movable between a first configuration at which the movable contact is remote from the stationary contact, and a second configuration at which the movable contact abuts the stationary contact, the movable contact having a catch which engages the reset latch in only the first position when the movable contact is in only the first configuration, wherein engagement of the catch with the reset latch holds the movable contact in the first configuration;

an actuator which moves the movable contact between the first and second configurations; and a manually operable reset actuator for selectively exerting a force which releases engagement of the catch with the reset latch.

11. The electrical switch as recited in claim 10 wherein the snap action blade comprises a center portion and first and second legs both joined to the center portion, the contact pad being coupled to the first and second legs, the first and second legs lying in a first plane and the center portion lying in a second plane, the snap action blade toggling between the first and second configurations when the first plane crosses the second plane.

12. The electrical switch as recited in claim 11 wherein the catch is coupled to the center portion.

13. An electrical switch comprising:

a reset latch having a first position and a second position;

a reset selector that acts on the reset latch to select whether the reset latch is in the first position or the second position;

a stationary contact;

a movable contact movable between a first configuration at which the movable contact is remote from the stationary contact, and a second configuration at which the movable contact abuts the stationary contact, the movable contact having a catch which engages the reset latch in only the first position when the movable contact is in only the second configuration, wherein engagement of the catch with the reset latch holds the movable contact in the second configuration;

an actuator which moves the movable contact between the first and second configurations; and a manually operable reset actuator for selectively exerting a force which releases engagement of the catch with the reset latch.

14. The electrical switch as recited in claim 13 wherein the snap action blade comprises a center portion and first and second legs both joined to the center portion, the contact pad being coupled to the first and second legs, the first and second legs lying in a first plane and the center portion lying in a second plane, the snap action blade toggling between the first and second configurations when the first plane crosses the second plane.

15. The electrical switch as recited in claim 13 wherein the catch is coupled to the center portion.

16. An electrical switch comprising:

a reset latch having a first position and a second position;

a reset selector that acts on the reset latch to select whether the reset latch is in the first position or the second position;

a body of electrically insulating material;

a stationary contact attached to the body;

a bias leaf spring supported by the body;

snap action blade having a center portion attached to the bias leaf spring, first and second legs joined to the center portion, and a contact pad coupled to the first and second legs, the first and second legs lying in a first plane and the center portion lying in a second plane, the snap action blade toggling between a first configuration and a second configuration when the first plane crosses the second plane, the contact pad abutting the stationary contact in the second configuration and being remote from the stationary contact in the first configuration;

an actuator which moves the snap action blade between the first and second configurations;

a catch coupled to the snap action blade and engaging the reset latch in only the first position when the movable contact is in only one of the first and second configurations, wherein engagement of the catch with the reset latch holds the movable contact in the one of the first and second configurations; and a manually operable reset actuator for selectively exerting a force which releases engagement of the catch with the reset latch.

* * * * *